US005405247A

United States Patent [19]

Goodman

[11] Patent Number: 5,405,247

[45] Date of Patent: Apr. 11, 1995

[54] PRE-CHARGED VACUUM FLUID CHARGE/DISPOSAL APPARATUS

[76] Inventor: Lowell R. Goodman, 803 Church St., Cambridge, Md. 21613

[21] Appl. No.: 913,650

[22] Filed: Jul. 13, 1992

Related U.S. Application Data

[63] Continuation of Ser. No. 545,078, Jun. 29, 1990, abandoned.

[51] Int. Cl.[6] ..... F04F 3/00

[52] U.S. Cl. ..... 417/139; 417/143; 417/148; 417/53; 184/1.5

[58] Field of Search ..... 417/53

[56] References Cited

U.S. PATENT DOCUMENTS

| | | | |
|---|---|---|---|
| 3,319,578 | 5/1967 | Ware | 417/148 |
| 4,095,672 | 6/1978 | Senese | 184/1.5 |
| 4,354,574 | 10/1982 | Rieber | 184/1.5 |
| 4,378,026 | 3/1983 | Bauer | 184/1.5 |
| 4,514,977 | 5/1985 | Bowen | 417/148 |
| 4,524,801 | 6/1985 | Magnasco et al. | 417/148 |
| 4,524,811 | 6/1985 | Taylor | 184/1.5 |
| 4,997,003 | 3/1991 | Brennan | 184/1.5 |

*Primary Examiner*—Richard A. Bertsch
*Assistant Examiner*—Roland G. McAndrews
*Attorney, Agent, or Firm*—Stan Jones

[57] ABSTRACT

An apparatus and method of use thereof includes a rechargeable, pre-charged vacuum canister used to remove viscous fluids, e.g., waste oil, from containers such as engine crankcases through an opening, such as a dipstick tube. The self-contained canister is first pre-charged with a near absolute vacuum. Due to the compressibility characteristics of air, conventional, active, continuous pumping techniques, which rely on partial vacuums, do not achieve the pulling force of the near absolute vacuums achieved by the invention. The use of a self-contained, pre-charged near absolute vacuum canister system significantly increases the force applied to the viscous fluid to be extracted. Furthermore, the fluid can be simultaneously contained in a proper disposal container. As a result shortcomings of manual and electric pumping systems are overcome with the added advantage that no external pumping force is required at the site of fluid removal.

9 Claims, 6 Drawing Sheets

PRE-CHARGED VACUUM FLUID CHARGE/DISPOSAL APPARATUS

This is a continuation application of pending U.S. application entitled PRE-CHARGED VACUUM FLUID CHARGE/DISPOSAL APPARATUS having Ser. No. 07/545,078 filed on Jun. 29, 1990 by Lowell R. Goodman and abandoned after this continuing application was filed.

BACKGROUND OF THE INVENTION

1. Field of the Invention

The invention relates to the field of vacuum "pumping" systems for extracting fluids from difficult access areas such as engine crankcases, and transmission reservoirs. Specifically, the invention relates to a vacuum operated pumping system which extracts viscous fluids through small diameter openings (e.g., engine crankcases through oil dipstick holes).

2. Related Art

Many oil pumping systems for marine, automotive, aviation and stationary engines have been proposed. These systems have evolved to facilitate the periodic oil change requirement for these engines.

The primary factor driving the evolution of these extraction systems is the limited access underneath or difficult access to an engine's gravity drain system. Most attempts to alleviate these access problems have been directed toward manual or electric pumping systems, which pump oil or other fluid up through a small tube inserted through the engine dipstick tube. By design, these systems use "pumping" techniques which are constrained by physics to apply only a small psi force to the oil or other fluid without the application of excessive electrical horsepower. Due to the compressibility characteristics of air in conjunction with viscous fluids, pumping techniques using suction, which rely on a partial vacuum, cannot achieve the pulling force of a near absolute vacuum. In addition, the pumps of such systems often require external sources of power, such as electric power, which may not be readily available. Thus, many systems presently in use are operationally difficult. Moreover, their designs are inherently prone to oil spills, since most systems do not provide an acceptable container for transporting waste oil or other fluid to a proper disposal facility.

Conventional pumping systems which employ partial vacuums also cannot utilize the full capacity of the tank or canister. This is because the incoming incompressilbe fluid rapidly begins compressing the remaining air in the partial vacuum canister, thereby reaching pressure equalization before the canister capacity is consumed. Pumping rates of systems which employ vacuum techniques also fail to provide a constant rate of pumping because only a partial vacuum is available initially. As the tank accepting the waste fluid becomes filled, the rate of pumping slows down due to the partial vacuum.

For the reasons stated above, there exists a need for a thorough, clean, pumping system that works efficiently and provides an appropriate receptacle for waste fluid until disposition.

SUMMARY OF THE INVENTION

In view of the above described limitations of the related art, it is an object of the invention to provide a method and apparatus for extracting fluid from a container without the need for externally powered pumps.

It is a further object of the invention to provide a method and apparatus for extracting fluid from a container that allows simple and clean extraction of fluid contained in difficult to access containers.

It is still another object of the invention to provide a method and apparatus for extracting fluid that allows the use of almost all the storage capacity of the recieving vessel.

It is still another object of the invention to provide a method and apparatus that extracts fluid from a container at a substantially constant rate, even in the absence of external power sources.

The invention seeks to overcome the shortcomings of conventional manual and electric liquid pumping systems and accomplish the above objects of the invention through an easily rechargeable, self-contained, pre-charged vacuum canister. The pre-charged canister can be transported to any site and used without any other energy source by actuating a simple on/off valve to apply the vacuum to the fluid. The invention includes a container suitable to maintain 29" of vacuum. The tank or canister is pre-charged to this level, either before or after transport to a pumping site. Further, an air actuated vacuum mechanism, such as a two stage venturi pump, may be incorporated to facilitate a user's recharging of the canister. With this device, the required vacuum is developed in a short period of time using a normal shop compressor or service station air system. Other vacuum pumps, such as manual or electrically powered pumps, may be employed in place of the air pressure activated venturi pump. Because of the full vacuum available initially, the system applies a near constant force throughout the extraction process until the container is above 95% full. This allows a near constant rate of extraction of the fluid into the canister throughout the entire extraction process. A tube suitable in size to be inserted into most dipstick holes is attached to the canister to withdraw waste fluid from its container. A valve suitable to maintain the vacuum is attached between the canister and the suction tube.

These and other objects of the invention will become apparent to one of skill in the art upon a reading of the following detailed description along with the accompanying drawings which form a part thereof.

DETAILED DESCRIPTION OF THE PREFERRED EMBODIMENTS

The invention involves the application of a near absolute vacuum via a pre-charged, self-contained canister which can be transported to any site and used without any other energy source to remove viscous engine liquids from difficult to access places. While several embodiments are described, it will be obvous to one of ordinary skill that other embodiments are also possible within the scope of the invention described herein and articulated in the claims. The embodiments include a basic version suitable for recharging by evacuating the canister through a suction tube, a pre-charged version easily applied to the rental market, a version employing an air pressure activated vacuum pump to establish the vacuum and two versions having a second compartment to carry replenishing fluid.

Figure 1:
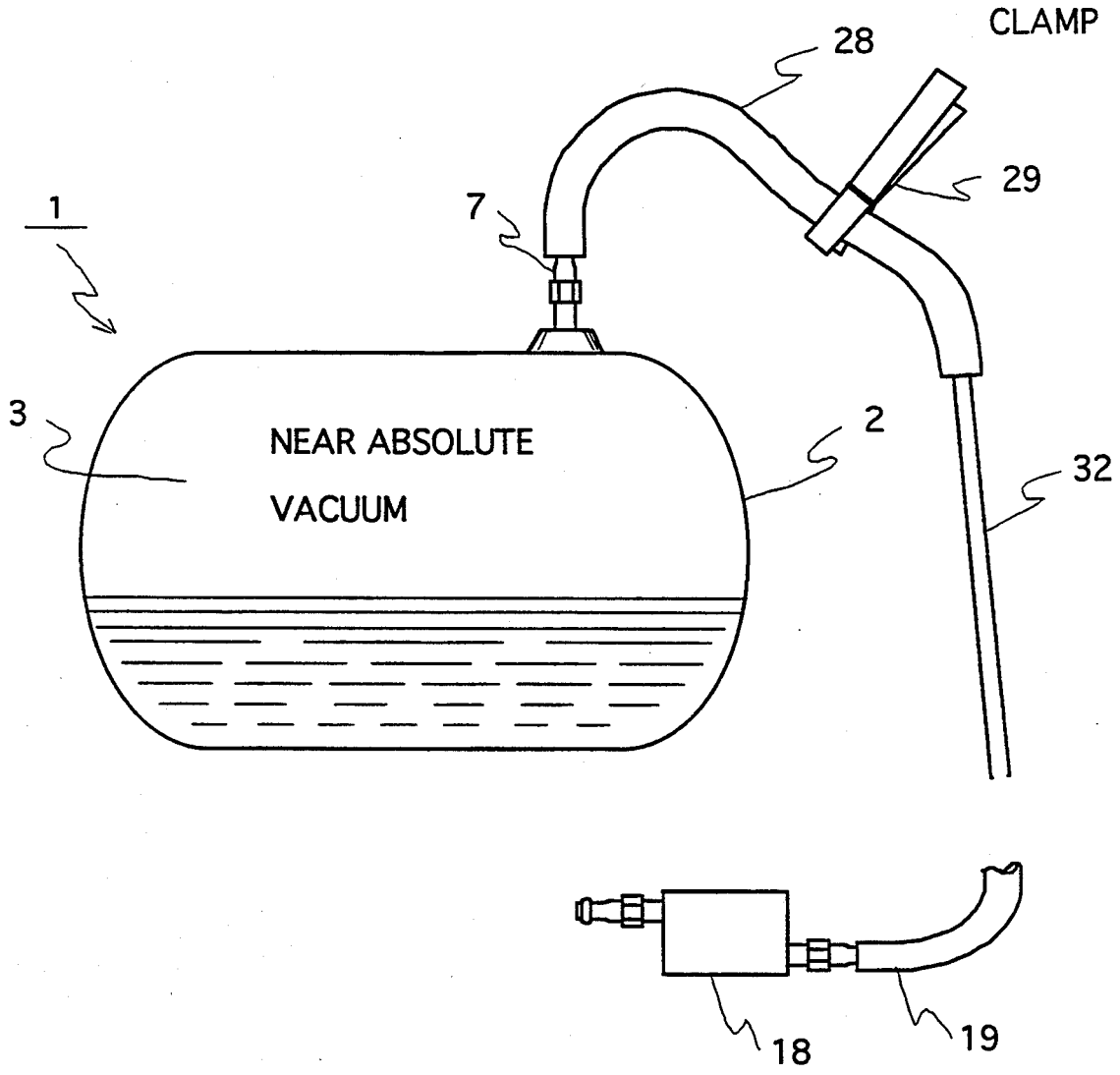
FIG. 1 illustrates a first embodiment of the invention.

In the first embodiment of the invention shown in FIG. 1, pre-charged canister system 1 has tank 2 formed of a suitable material to hold a viscous fluid and a vacuum in the inside 3 of the tank. By way of illustration only, and not as a limitation, the invention is described in the context of extracting oil from an engine crankcase. It will be clear to those of ordinary skill in the art that the principles of the invention are equally applicable to extracting other fluids from the same or other containers and that tank 2 and other parts of the invention can be formed by known means to accommodate the characteristics of such fluids. Tank 2 is connected by suction hose barb 7 located with access to the inside 3 of tank 2. Suction hose barb 7 connects to one end of suction hose 28 which can be clamped by a canister sealing or closing means, such as clamp 29. Clamp 29 may be an adjustable device permanently affixed by an attachment means to hose 28 or it may be a separate clamp placed and tightened on the hose where required. The other end of hose 28 is connected to a first end of a smaller diameter semi-rigid suction hose 32.

In order to evacuate tank 2 to approximately 29" of mercury, one end of hose 19 is slipped on the second end of semi-rigid tube 32. The other end of hose 19 is connected to any known vacuum pump 18, which is then activated. When the vacuum pump 18 reaches full vacuum, clamp 29 is placed on hose 28. The canister is thus pre-charged and ready for use in extracting fluid. It should be noted that the canister can be evacuated using a separate entry point and a check valve and that an on/off valve can be employed in place of clamp 29.

After charging, the pre-charged canister unit is then transported to the engine or other container to be drained. Of course, the canister unit can be charged at the site if so desired. Semi-rigid tube 32 is inserted to the bottom of the engine oil container through the engine dipstick tube in preparation of the engine oil change. Clamp or valve 29 is then removed to allow the vacuum actuated tank 2 to pull the oil out of the engine.

Warm waste engine oil is typically removed at the rate of approximately one quart per 40 seconds for a 3/16 inch inside diameter tube. Throughout this specification extraction rates assume a 3/16 inch inside diameter tube is used. It should be noted that where the inside diameter is larger the speed of extraction is faster. When the tube is clear, clamp 29 is replaced on suction hose 28 and semi-rigid hose 32 is then pulled from the dipstick tube, to complete the extraction process.

Waste fluid which is now in tank 2 in place of the vacuum, can then be drained. One draining process involves attaching a vacuum to the canister and sucking the oil out. Another draining method is to pressurize tank 2 either through the suction hose 28 or at hose barb 7 and turn the tank upside down, thereby putting the air pressure above the waste fluid. This will cause the fluid to be flushed from the tank.

Figure 2:
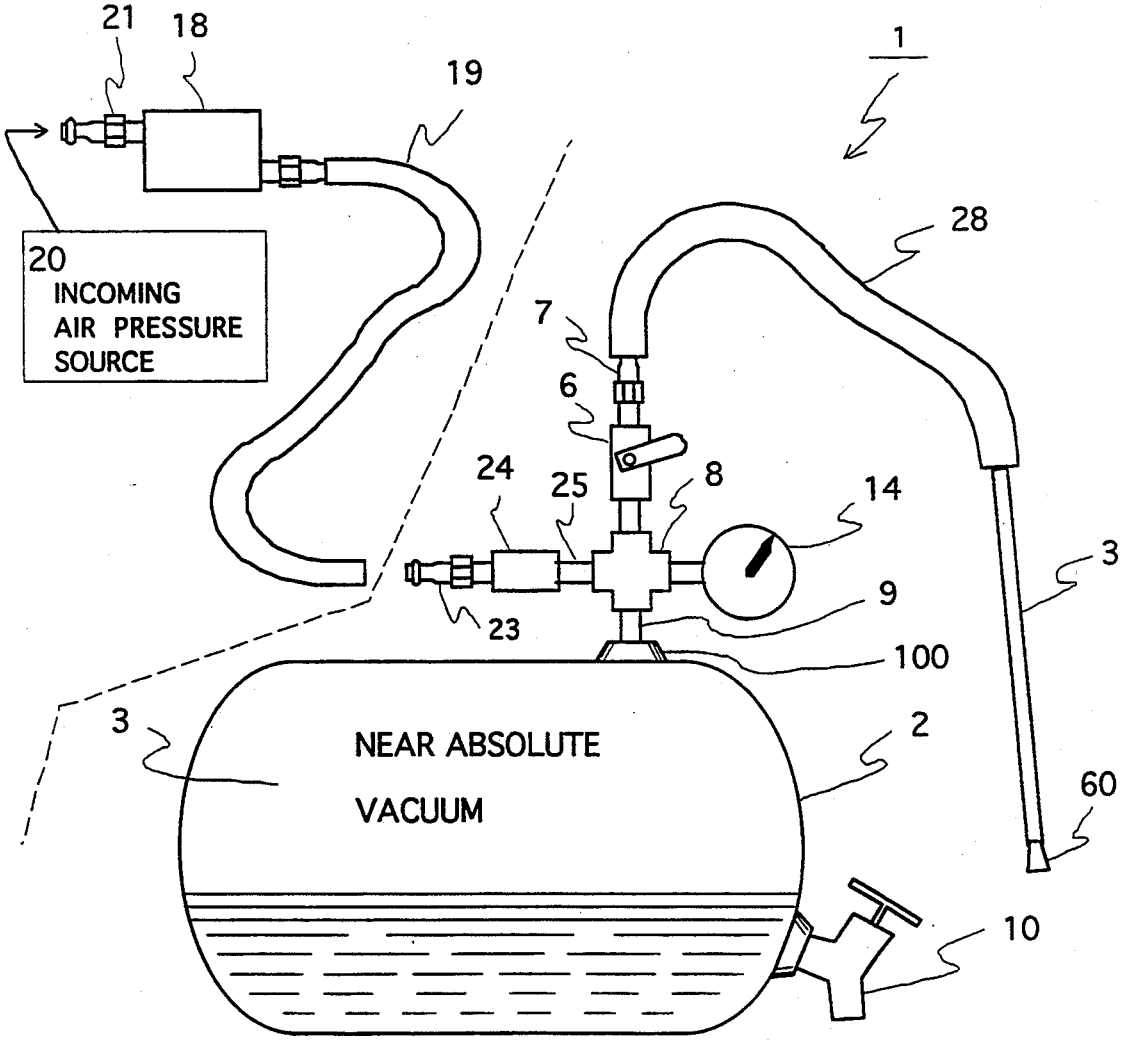
FIG. 2 illustrates a second embodiment of the invention employing a fluid disposal pre-charged vacuum canister.

In the embodiment shown in FIG. 2, nipple 9 at tank access 100 is attached to a first side of crossblock 8. Nipple 25 is attached between a second side of crossblock 8 and check valve 24, which mates with hose barb 23. Hose barb 23 can be used to attach hose 19, which is connected to vacuum pump 18. Check valve 24 operates to hold the vacuum in tank 2. A vacuum gage 14 can also be connected to the crossblock 8 to measure the vacuum. On/off valve 6 is connected between the crossblock 8 and suction hose barb 7 to control the vacuum which pulls fluid from a container (not shown) through semi-rigid suction hose 32 and suction hose 28.

In operation, the tank 2 is evacuated to approximately 29" of mercury through hose 19, check valve 24, nipple 25, and valve 6 by way of external vacuum pump 18. In one kind of vacuum pump, any available pressurized air source 20 is attached for several minutes to the pump 18 using quick coupler 21. Air pressure through the vacuum pump 18 creates a vacuum in the tank 2. Hose 19 temporarily attaches the vacuum pump to the tank by way of hose barb 23, check valve 24, nipple 25, crossblock 8 and nipple 9.

The level of vacuum inside canister compartment 3 is read on vacuum gage 14 which monitors the vacuum in the tank through the crossblock 8. Once 29" or other appropriate level of vacuum is reached on gage 14, check valve 24 holds the vacuum in tank 2. The canister is thus pre-charged. The pump 18 and vacuum hose 19 are then removed from hose barb 23 and the canister is ready for use. Alternately, the unit may use a check valve at a separate entry point for holding the vacuum.

The pre-charged canister unit is then transported to the engine and semi-rigid tube 32 is inserted into the bottom of engine oil container through the engine dipstick tube (not shown) in preparation of the engine oil change. The valve 6 is then turned to the "vacuum on" position and the vacuum pulls the oil out of the engine.

Warm waste engine oil is typically removed at the rate of approximately one quart per 40 seconds. When the tube is clear, valve 6 is shut off, semi-rigid tube 32 is pulled from the engine dipstick tube (not shown), and the process is complete. The waste oil which is now in the tank in place of the vacuum can then be drained through drain petcock 10 at an appropriate facility and the unit can then be readied via the same pre-charging process for another use.

Figure 3:
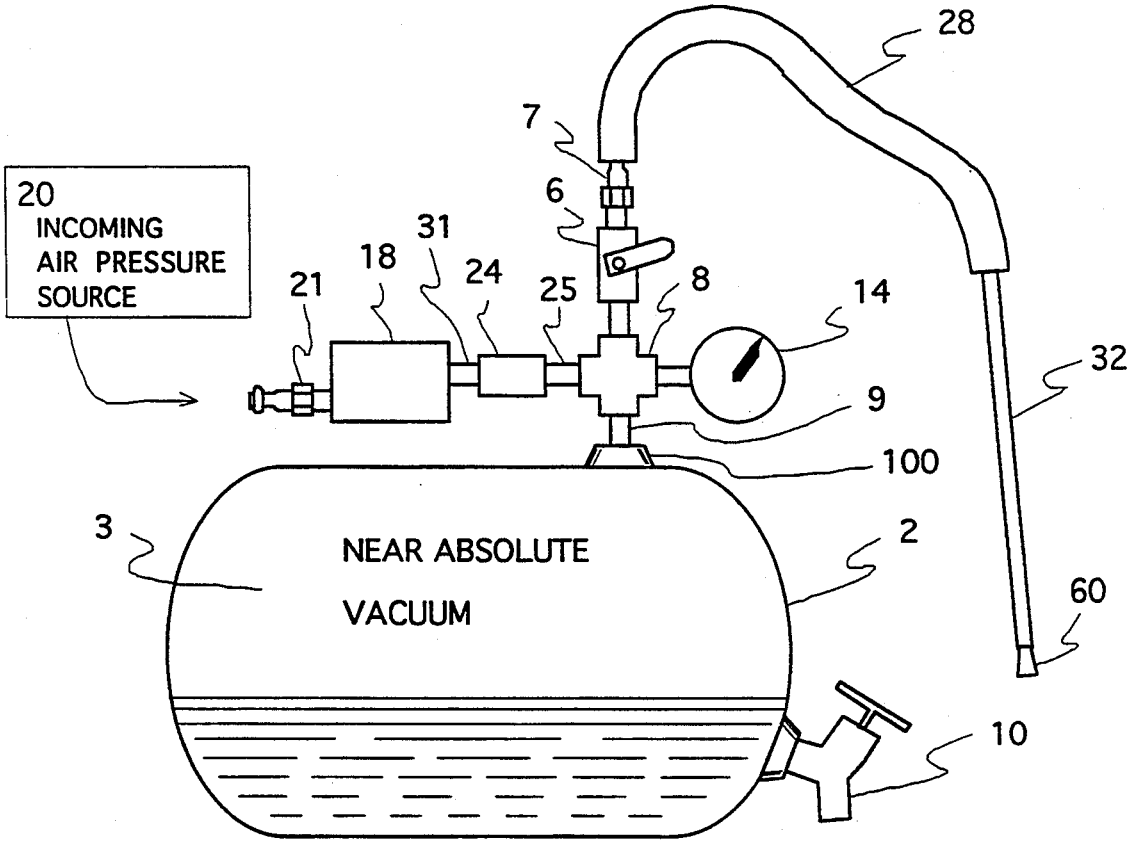
FIG. 3 illustrates a third embodiment of the invention employing an air pressure activated vacuum pump.

FIG. 3 shows an embodiment similar to that of FIG. 2 but with an air activated pump which is a part of the system 1. In this variation, the vacuum is created by an integral two-stage venturi 18, through a nipple 31, to check valve 24. This integral two-stage venturi 18 can be energized by air pressure of approximately 60–90 psi and 0.5 to 1.3 cubic feet per minute (cfm). This allows the unit to be charged with any air compressor 20 having proper pressure, such as those typical of local service stations, which can be attached, for example, to quick coupler 21.

The unit is charged by applying the pressurized air to the vacuum pump 18 through quick coupler 21. Typically, the tank 2 can be vacated to 29 inches of mercury in several minutes. Once the air pressure is removed, check valve 24 holds the vacuum. The level of vacuum is read on vacuum gage 14 which monitors the vacuum in the tank through the crossblock 8, as previously described. Once 29" or other desired level of vacuum is reached on gage 14, the external quick coupler 21 is disconnected and the check valve 24 holds the vacuum in the tank, leaving the canister charged and ready for use.

The entire system 1 is then transported to the engine and semi-rigid tube 32 is inserted into the bottom of an engine oil container through the engine dipstick tube (not shown) in preparation of the engine oil change. The valve 6 is then turned to the "vacuum on" position and the vacuum pulls the oil out of the engine. Warm engine oil is removed at the rate of approximately one quart per 40 seconds. When semi-rigid tube 32 is clear, valve 6 is shut off, semi-rigid tube 32 is pulled from the dipstick tube, and the process is complete.

The waste oil which is now in the tank in place of the vacuum can then be drained through drain petcock 10 at an appropriate facility and the unit can then be readied via the same pre-charging process for another use.

Figure 4:
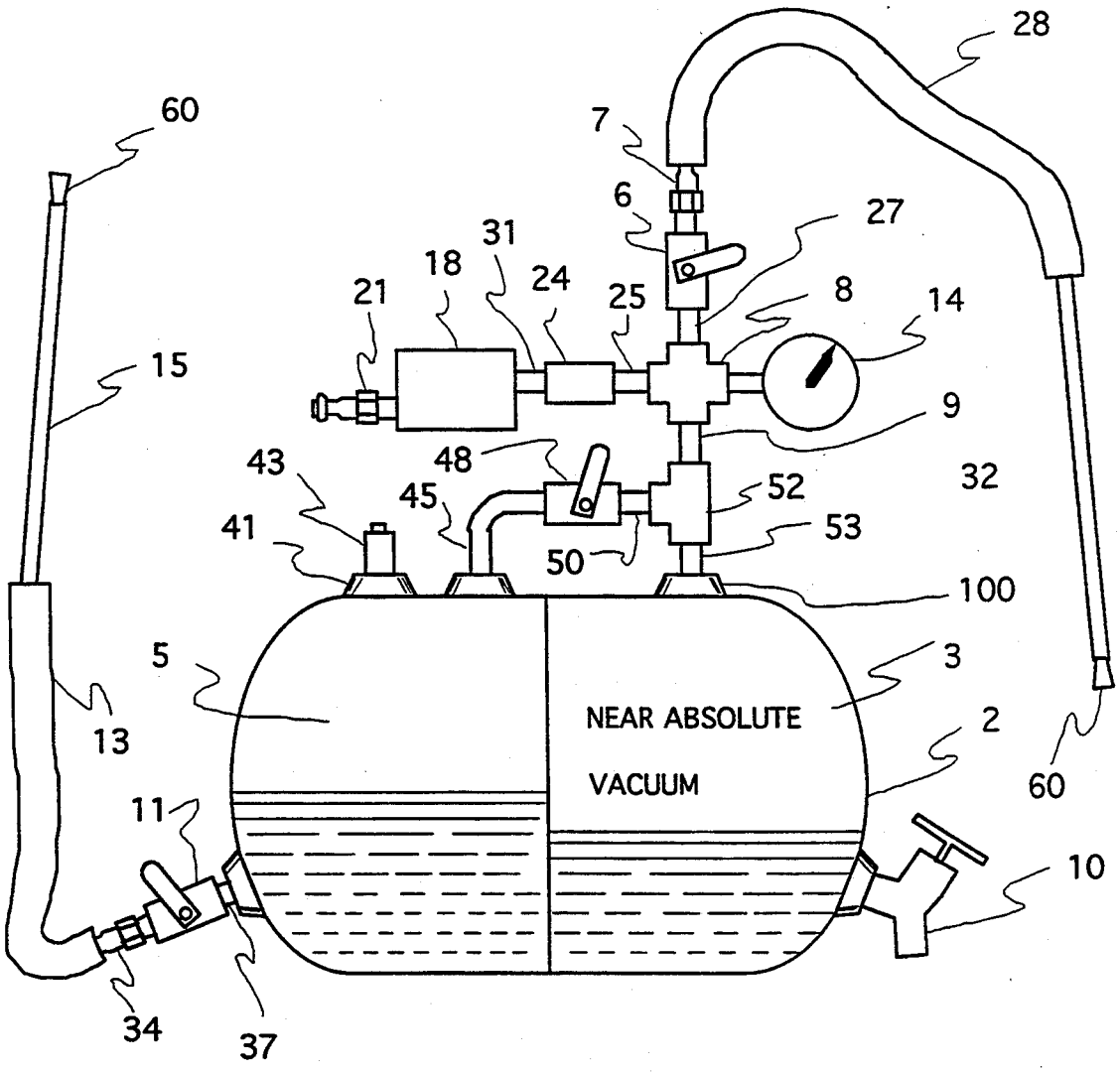
FIG. 4 illustrates an embodiment of the invention employing a vacuum charged compartment and a fluid refill compartment in a two compartment canister unit.

FIG. 4 illustrates an embodiment employing a two compartment canister and valve system which extracts and replaces fluid through two tubes. The charging and fluid extraction components of the system shown in FIG. 4 are the same as those discussed relative to FIG. 3. The versions discussed in FIGS. 1 and 2 could also be substituted for this part of the system. The extraction approach using the two compartment tank is the same as previously described for the pre-charged canister. However, the second compartment can contain bulk oil, typically slightly pressurized, which the user can use to replace the extracted fluid.

As shown in FIG. 4, tank 2 is configured to have two compartments. Compartment 3 is evacuated as described above and used to collect waste fluid, also as described above. Compartment 5 of tank 2 can be filled with fresh oil or another fluid to replenish the fluid extracted from the container from which it was drawn. Compartment 3 is connected via nipple or connecting tube 53 to one side of tee-block 52. Connector 50 connects valve 48 to the tee-block. The other side of valve 48 is connected through connector 45 to compartment 5 of tank or canister 2. The remaining side of tee-block 52 is connected to crossblock 8 through connector 27. When valve 48 is in an open position, compartments 3 and 5 are in communication through connectors 45, 50, and 53 and tee-block 52. As a result, connector 25 provides a common connection to vacuum pump 18 through check valve 24 and crossblock 8 for evacuating both compartments 3 and 5 simultaneously.

In application, tank 2 is evacuated to approximately 29" of mercury through valve 6 by way of attached, system venturi pump 18. Any available pressurized air source can be attached to the two stage venturi pump 18 by the air fitting 21. The air pressure through the venturi pump creates a vacuum in the tank, typically reaching the required levels in a few minutes. Alternatively, this embodiment can be configured with a manually or electrically powered vacuum pump. The level of vacuum is read on vacuum gage 14, which monitors the vacuum in the tank through the crossblock 8. Once 29" or other appropriate level of vacuum is reached on gage 14, the air input or other vacuum source is disconnected and the check valve 24 holds the vacuum in the tank. The second compartment 5 can be filled with the required replacement fluid by removing plug 41 and directly pouring oil or other fluid into an opening 37 in tank 2 that directs fluid into compartment 5.

Alternately, replacement fluid can be pulled into compartment 5 using the same vacuum process previously described in the other embodiments for extracting waste fluids. This is accomplished by opening valve 48 and closing valves 6 and 11. An external air pressure source is attached to air fitting 21 and vacuum pump 18, thus evacuating both compartments 3 and 5. Upon completing the evacuation, valve 48 is closed, thereby separating vacuum charged compartments 3 and 5. Oil tube 15 is then placed into a replacement fluid container (not shown) and valve 11 is turned to the "on" position, allowing the replenishment fluid to enter compartment 5. The vacuum in compartment 5 pulls the replenishment fluid through tube 15, hose 13, and valve 11 into compartment 5. Valve 11 is then turned off and a drip plug 60 is inserted into tube 15. The entire system 1 is thus pre-charged with a vacuum in compartment 3 for removing the waste liquid from its container and with replacement fluid in compartment 5.

Compartment 5 is then charged with air pressure through air valve 43 attached through plug 41, for example, to approximately 20 psi. The clean oil side of the canister, compartment 5, is pressurized, for example to 20 psi, in order to assist the replenishment fluid in traveling through valve 11 and tube 13 to the engine. Both compartments of the tank or canister 2 are now charged for operation, since compartment 3 has a vacuum for extracting waste fluid from a container and compartment 5 is charged for dispensing replenishment fluid into the container. The entire system 1 is then transported to the engine and semi-rigid tube 32 is inserted into the bottom of an engine oil container through the engine dipstick tube (not shown) in preparation of the engine oil change. The valve 6 is turned to the "vacuum on" position and the vacuum then pulls the oil out of the engine.

Warm waste engine oil is typically removed at a rate of approximately one guart per 40 seconds. When the tube is clear, the valve is shut off, the semi-rigid tube 32 is pulled from the dipstick, and the process is complete. Plug 60 is inserted into the end of semi-rigid tube 32 to seal off any remaining oil drips. Clean oil is assisted into the engine by opening valve 11 and allowing the air pressure to push oil from compartment 5 through the delivery tube 13 and semi-rigid tube 5 into the engine. The waste oil now in compartment 3 can be drained thru drain petcock 10 at an appropriate facility and the unit can then be readied via the same dual pre-charging process described above for the next user.

Figure 5:
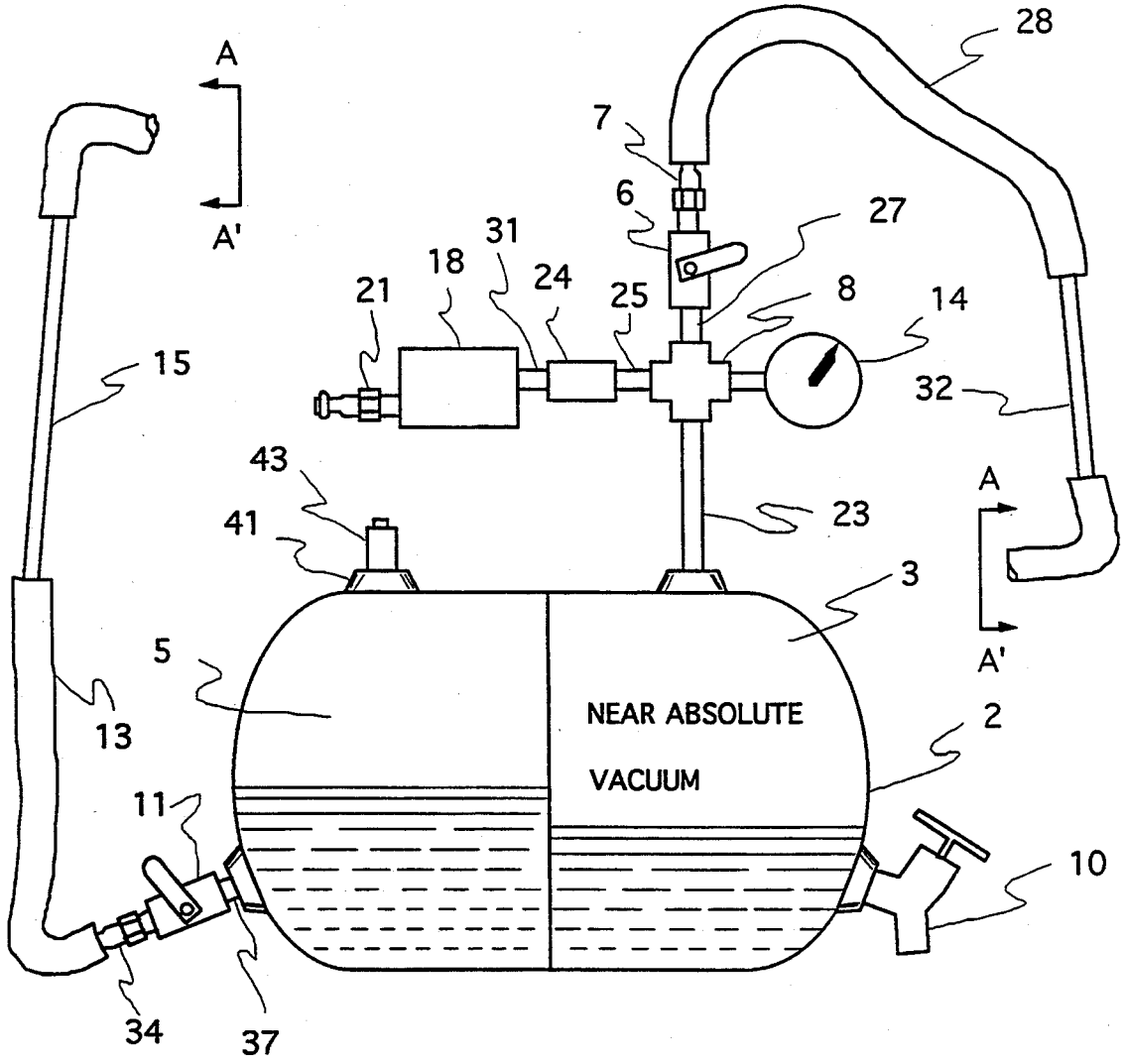
FIG. 5 illustrates another two compartment embodiment employing a valve arrangement to provide vacuum to the compartments.

FIG. 5 illustrates an embodiment employing the two compartment canister without the need for valve 48 and its connecting components. In FIG. 5, the charging and fluid extraction components are the same as those of FIG. 4. By employing the same vacuum process described above, replenishment fluid may be removed from a container (not shown) through hose 13 and valve 11 into compartment 5 of tank or canister 2 using the precharged vacuum approach discussed above.

Simultaneous evacuation of compartments 3 and 5 is accomplished by sliding an interconnecting means, such as hose 39, onto semi-rigid tubes 32 and 15. Alternately, tubes 15 and 32 can be preformed to be interconnectable. Interconnecting the tubes by either method applies the vacuum created by pump 18 to both compartments 3 and 5 simultaneously when valve 6 is opened. As previously discussed, once compartment 5 is charged with vacuum, clean oil dispursement tube 15 acts as a suction tube to take replenishment fluid into compartment 5. After replenishment fluid has been placed into compartment 5, valves 6 and 11 are closed. Next, compartment 5 is pressurized, for example to 20 psi, through air fitting 43 and plug 41. The unit is then charged and ready for use. Alternatively, a plug 41 is provided for removal, so oil may be poured into the tank directly.

At the extraction site, the extraction process is the same as the other embodiments. Valve 6 is then turned to the "vacuum on" position and the vacuum then pulls the oil out of the engine. Waste engine oil is removed by the vacuum. When the semi-rigid tube 32 is clear and the extraction process is complete, clean oil is dispensed into the engine by inserting tube 15 into the dipstick hole, turning valve 11 to the open position and allowing the pre-charged pressurized (e.g., 20 psi) compartment 5 to push oil through the delivery tube into the engine. The waste oil can be drained thru drain petcock 10 at an appropriate facility. The unit can then be readied via the same dual pre-charging process for the next use.

Figure 6:
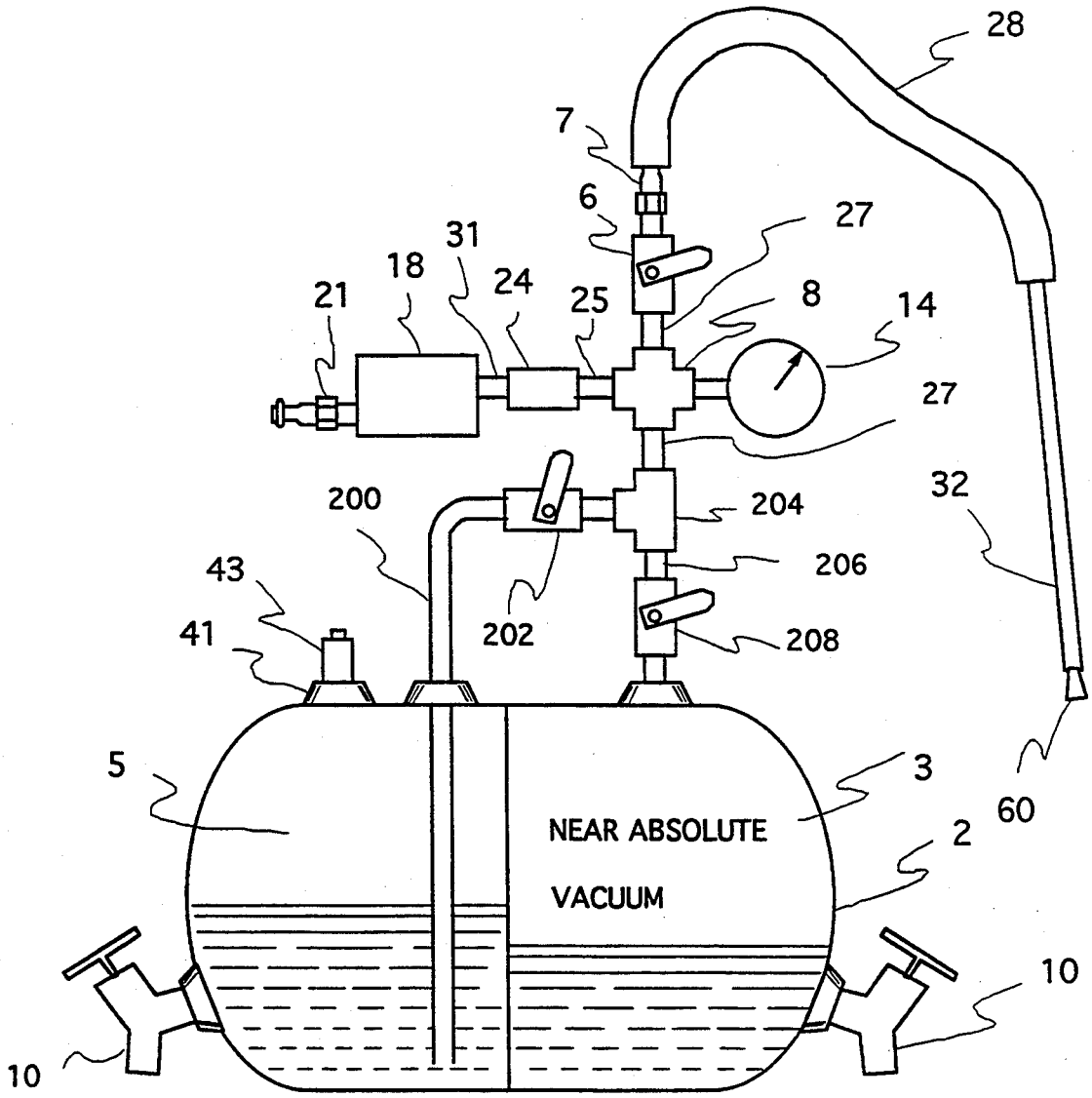
FIG. 6 illustrates a two compartment embodiment that employs a single hose for extracting and dispersing fluids.

FIG. 6 shows a configuration requiring only a single hose, which is used both for extracting waste fluid and for dispensing replenishment fluid. In this configuration, compartment 5 is connected to valve 202 through connector 200. Connector 200 is connected on one side of tee-block 204 which is connected through connected 27 to crossblock 8 and through connector 206 to valve 208. Both compartments can be precharged by opening both valves 202 and 208 while valve 6 is closed and vacuum pump 18 is activated, for example, using an external air pressure source applied at air connector 21. It should be noted that in all the embodiments discussed herein, any known vacuum pump means can be employed as pump 18, including manual and electrical pumps. Air pressure activated venturi pumps may be advantageous, since these can be powered from air pressure pumps typically available at service stations. Upon completing evacuation of compartments 3 and 5, valves 202 and 208 are closed. In order to place replenishment fluid in compartment 5, semirigid tube 32 is placed in a replenishment fluid reservoir (not shown) and valves 6 and 202 are opened while valve 208 remains closed. Replenishment fluid is drawn into compartment 5 as it replaces the vacuum in this compartment. Valve 202 is then closed and compartment 5 is then pressurized by applying air pressure through air valve 43.

A similar process as that described above is employed to extract waste oil from an engine oil container (not shown). In this case, however, valve 202 remains closed and valves 6 and 208 are opened to direct the extraction of the waste fluid through tubes 32 and 28 into compartment 3. When the extraction process is completed, valve 208 is closed and valve 202 is again opened to force replenishment fluid out of pressurized compartment 5 through tee-block 204, crossblock 8, valve 6, and tubes 28 and 32 into the engine oil container.

In the above embodiments, a near complete vacuum is generated in each canister or compartment. Thus, a substantially constant suction force is applied in each case. This results in a substantially constant rate of drawing fluid. Moreover, once the system is charged it is not necessary to apply any external power source to extract fluid, since the precharged vacuum provides all the extraction force required. The actual oil suction capacity is a function of the amount of vacuum drawn. The oil capacities shown below are calculated as tank volume times the inverse ratio to the starting vacuum pressure.

TABLE 1

| Starting Vacuum | | CAPACITIES AT VACUUM | |
|---|---|---|---|
| INCHES | | 5 GALLON | 10 GALLON |

TABLE 1-continued

| PSI EQUALS | OF MERCURY | TANK Oil | TANK Air | TANK Oil | TANK Air |
|---|---|---|---|---|---|
| 14.70 | 29.90 | 5.00 | .00 | 10.00 | .00 |
| 14.63 | 29.75 | 4.97 | .03 | 9.95 | 0.05 |
| 14.00 | 28.48 | 4.76 | .24 | 9.52 | .48 |
| 13.50 | 27.46 | 4.59 | .41 | 9.18 | .82 |
| 13.00 | 26.44 | 4.42 | .58 | 8.84 | 1.16 |
| 12.50 | 25.43 | 4.25 | .75 | 8.50 | 1.50 |
| 12.00 | 24.41 | 4.08 | .92 | 8.16 | 1.84 |
| 11.50 | 23.39 | 3.91 | 1.09 | 7.82 | 2.18 |
| 11.0 | 22.37 | 3.74 | 1.26 | 7.48 | 2.52 |
| 10.50 | 21.36 | 3.57 | 1.43 | 7.14 | 2.86 |
| 10.00 | 20.34 | 3.40 | 1.60 | 6.80 | 3.20 |
| 9.50 | 19.32 | 3.23 | 1.77 | 6.46 | 3.54 |
| 9.00 | 18.31 | 3.06 | 1.94 | 6.12 | 3.88 |
| 8.50 | 17.29 | 2.89 | 2.11 | 5.78 | 4.22 |
| 8.00 | 16.27 | 2.72 | 2.28 | 5.44 | 4.56 |
| 7.50 | 15.26 | 2.55 | 2.45 | 5.10 | 4.90 |
| 7.00 | 14.24 | 2.38 | 2.62 | 4.76 | 5.24 |
| 6.50 | 13.22 | 2.21 | 2.79 | 4.42 | 5.58 |
| ATMOSPHERIC PRESSURE | | CAPACITIES AT VACUUM | | | |
| PSI EQUALS | INCHES OF MERCURY | 5 GALLON TANK Oil | 5 GALLON TANK Air | 10 GALLON TANK Oil | 10 GALLON TANK Air |
| 6.00 | 12.20 | 2.04 | 2.96 | 4.08 | 5.92 |
| 5.50 | 11.19 | 1.87 | 3.13 | 3.74 | 6.26 |
| 5.00 | 10.17 | 1.70 | 3.30 | 3.40 | 6.60 |
| 4.50 | 9.15 | 1.53 | 3.47 | 3.06 | 6.94 |
| 4.00 | 8.14 | 1.36 | 3.64 | 2.72 | 7.28 |
| 3.50 | 7.12 | 1.19 | 3.81 | 2.38 | 7.62 |
| 3.00 | 6.10 | 1.02 | 3.98 | 2.04 | 7.96 |
| 2.50 | 5.09 | .85 | 4.15 | 1.70 | 8.30 |
| 2.00 | 4.07 | .68 | 4.32 | 1.36 | 8.64 |
| 1.50 | 3.05 | .51 | 4.49 | 1.02 | 8.98 |
| 1.00 | 2.03 | .34 | 4.66 | .68 | 9.32 |
| .50 | 1.02 | .17 | 4.83 | .34 | 9.66 |
| .00 | .00 | .00 | 5.00 | .00 | 10.00 |

While the invention has been particularly shown and described with reference to several preferred embodiments, it will be understood by those skilled in the art that various changes in form and detail may be made without departing from the scope and spirit of the invention recited in the appended claims.

What is claimed is:

1. A pre-charged, self-contained and self-suctioning apparatus for drawing fluid from a container where external power is not used, said apparatus comprising:

a pre-charged canister having an open/close control valve and a high-vacuum check valve for evacuating and capturing a finite volume at a near absolute vacuum over 28 inches of mercury and in the range of 28 to 29.95 inches of mercury in said pre-charged canister;

a hose having a first end attached to said pre-charged canister through said control valve and a second end for placement into a fluid in the container; and means including said control valve, when said control valve is in a vacuum open condition, for releasing the captured and finite vacuum in said precharged canister, the released finite near absolute vacuum self-suctioning fluid from the container through the hose at a substantially constant suction force and into the canister without the use of external power; and said apparatus characterized in that the suctioned fluid from the container replaces the near absolute vacuum in the canister by self-suctioning fluid from the container into substantially the entire volumetric capacity of said canister.

2. The apparatus recited in claim 1 wherein the hose comprises:

a first diameter hose portion having a first end attached to the control valve on the canister and a second end attached to one end of a second, smaller diameter hose portion, a seal being formed between the first and second hose portions, another end of the second, smaller diameter hose portion being for insertion into the fluid in the container; and a vacuum type drip cap adapted to be fitted on the insertion end of said second hose when said self-suctioning apparatus is not in use.

3. The apparatus recited in claim 1 further comprising a high vacuum check valve, the check valve having a first end for connection to a vacuum generating source and a second end connected between a vacuum pump and the canister, the check valve being adapted for, and oriented to capture the near absolute vacuum generated in the canister by the vacuum generating source.

4. The apparatus recited in claim 3 and further comprising a control valve located between the hose and the canister, said control being characterized in that it initially seals the canister, and later during self-suctioning applies the near absolute vacuum of the canister to the fluid to be withdrawn through the hose into the canister.

5. The apparatus recited in claim 4 and further comprising an air pressure driven vacuum pump integrally connected to the first end of the high vacuum check valve.

6. A method of self-withdrawing and safely self-containing fluid from a container into a sealed canister, which canister has a high vacuum check valve and an open/close control valve to selectively capture and then expose a captured vacuum within said canister to a liquid to be withdrawn from said container, which container is subject to atmospheric pressure and is located where external power may not be available for said fluid withdrawal, the method comprising the steps of:

adapting a self-withdrawing canister from a hollow right angle cylinder fitted with rounded ends so that said canister is capable of withstanding within said canister, an absolute vacuum of 29.92 inches of mercury;

pre-charging said canister by evacuating the canister through an air-driven two-stage venturi having its outlet connected through a high-vacuum check valve into said canister to form a near absolute vacuum in the canister in the range of over 28 inches of mercury and about 28 to 29.95 inches of mercury;

sealing the canister at said near absolute vacuum with said closed control valve and said high-vacuum check valve in order to provide said self-withdrawing capability for said canister;

creating, in said sealed canister, a captured finite volume at said near absolute vacuum of over 28 inches of mercury and about 28 to 29.95 inches of mercury to provide for complete portability and subsequent remote site use of said captured and finite volume;

positioning said pre-charged evacuated canister and the container having the fluid to be withdrawn together at a location that may not have any external power;

placing a first end of a hose in fluid communication through said open/close valve into the sealed evacuated canister and a second end of the hose into a fluid to be withdrawn from said container;

opening said control valve in order to thereby expose the container's fluid to the maximum available differential pressure between atmospheric and said captured finite near absolute vacuum in said canister;

suctioning, in response to said atmospheric pressure at said container and said near absolute vacuum in said canister, fluid from the container through the hose and into the canister without the use of any other external power;

replacing the captured finite near absolute vacuum in the canister with the withdrawn fluid from the container to a fill capacity of over 95% of the total volumetric capacity of said canister; and maintaining said near maximum available differential pressure throughout most of the fill cycle for said canister as said fluid is withdrawn from said container into said canister.

7. The method recited in claim 6 wherein the canister is evacuated by applying air pressure to a vacuum pump permanently attached to the canister through said high vacuum check valve.

8. The method recited in claim 6 wherein the canister is evacuated to said near absolute vacuum by using compressed air from a standard shop or service station compressor to drive said two-stage venturi as a vacuum pump; and integrally connecting said two-stage venturi pump to said canister through a high-vacuum check valve that is also integrally connected to said canister in order to capture the finite volume at said near absolute vacuum in the canister.

9. The method recited in claim 8 wherein the near absolute vacuum is generated by applying an air pressure source to a vacuum pump, with said vacuum pump being permanently connected to the high-vacuum check valve.

* * * * *